US007468004B2

(12) United States Patent
Kim

(10) Patent No.: US 7,468,004 B2
(45) Date of Patent: Dec. 23, 2008

(54) DEVICE FOR CORRECTING GOLF SWING POSTURE

(76) Inventor: Buhm Soo Kim, 103-102 Gangbyunturanchae Apartment 1251-Bunji, Anrak-Dong, Dongnae-Gu, Busan, 607-100 (KR)

( * ) Notice: Subject to any disclaimer, the term of this patent is extended or adjusted under 35 U.S.C. 154(b) by 0 days.

(21) Appl. No.: 11/742,501

(22) Filed: Apr. 30, 2007

(65) Prior Publication Data

US 2008/0146364 A1 Jun. 19, 2008

(30) Foreign Application Priority Data

Dec. 14, 2006 (KR) ..... 10-2006-0127678

(51) Int. Cl.
*A63B 69/36* (2006.01)

(52) U.S. Cl. ..... 473/269; 473/217

(58) Field of Classification Search ..... 473/266, 473/269, 270, 271, 272, 273, 464, 207, 217; 602/27

See application file for complete search history.

(56) References Cited

U.S. PATENT DOCUMENTS 4,103,897 A * 8/1978 Ostyn ..... 473/217
4,657,258 A * 4/1987 Melov et al. ..... 473/272
4,834,078 A * 5/1989 Biedermann ..... 602/27
5,069,202 A * 12/1991 Prock ..... 602/27
5,090,138 A * 2/1992 Borden ..... 36/102
5,209,722 A * 5/1993 Miklaus et al. ..... 602/27
5,443,267 A * 8/1995 Thorson ..... 473/217
5,778,563 A * 7/1998 Ahlbaumer ..... 36/88
6,350,246 B1 * 2/2002 DeToro et al. ..... 602/27
6,689,081 B2 * 2/2004 Bowman ..... 602/27
6,824,523 B2 * 11/2004 Carlson ..... 602/16

* cited by examiner

*Primary Examiner*—Nini Legesse
(74) *Attorney, Agent, or Firm*—Park & Associates IP Law LLC

(57) ABSTRACT

Disclosed herein is a device for correcting golf swing posture. The device includes a footboard which is formed so that a foot is seated and supported thereon, and has a pair of facing locking brackets and a foot support part for supporting a foot. A support cuff is provided at an end of the footboard to support a leg, a lower surface of the support cuff, which contacts the footboard, being formed to be convex such that the support cuff rotates within a range of swing motion, the support cuff having locking recesses which are coupled to the locking brackets and a leg support part for supporting the leg. A fastening means detachably fastens the locking brackets of the footboard to the locking recesses of the support cuff. Thereby, the support cuff rotates about the fastening means at a predetermined angle as swing motion is conducted. Therefore, the support cuff can rotate relative to the footboard at a predetermined angle within the range of swing motion, so that the posture correction device can precisely correct swing posture, and can perfectly apply and support swing power, thus improving swing power, and making the ball fly in the desired direction, therefore improving golfing performance.

11 Claims, 3 Drawing Sheets

DEVICE FOR CORRECTING GOLF SWING POSTURE

FIELD OF THE INVENTION

The present invention relates generally to a device for correcting golf swing posture and, more particularly, to a device for correcting golf swing posture, which is constructed so that a support cuff rotates relative to a footboard to correspond to the range of swing motion, thus correcting swing posture, and applying and supporting swing power.

BACKGROUND OF THE INVENTION

Generally, when a golfer performs a swing with a golf club, reaction force acts on his or her feet at the point where his or her feet contact the ground, and this force is transmitted from the legs to the upper body. Thereby, the golfer's body is sequentially rotated. For a right-handed golfer, at address (preparation stance), the center of his or her weight is located at the center of the body. As the golfer performs a swing, the center of the weight is shifted to the right, and then is shifted to the left.

While the golfer performs a backswing and a follow-through, the legs, waist, and shoulders must apply power appropriately. Each body part itself applies power, and in addition, supports other body parts such that they apply power. Especially, the legs scarcely rotate, compared to other body parts, but apply power through the rotation of the waist and shoulders.

When the body parts evenly apply power, appropriate power is generated during a swing, and the golfer can precisely hit a ball such that the ball flies to the intended location.

During the backswing, the shoulders turn slightly backwards to the right, so that force is loaded on the shoulders. Simultaneously, the left foot leans slightly to the center of the body, and the right side of the waist turns backwards. In this case, if the left foot leans excessively to the center of the body, the right side of the waist turns backwards excessively, so that excessive force is loaded on the shoulders, or the rotating force of the shoulders does not support the waist because the waist turns backwards excessively, so that swing power is decreased, and the ball may be hit in a direction other than the desired direction.

Further, during the follow-through, the shoulders turn backwards to the left, and force is removed from the shoulders. Simultaneously, during a motion subsequent to a downswing, the left foot may lean outwards excessively because of the swing power of the shoulders. Such a posture results in an unstable swing, so that swing power is dispersed, and the ball may be hit in the wrong direction.

This problem occurs especially frequently in beginners. Unless a beginner learns the correct swing posture from the start, bad swing posture becomes a habit, and it becomes difficult to overcome the bad swing posture. Further, swing power cannot be efficiently applied, so that the golfing performance is poor, and the beginner loses interest in playing golf.

In order to solve the problems, Korean U.M. Registration No. 20-0183683 has been proposed, which prevents one leg from excessively moving, and is entitled "Device For Correcting Golf Swing Posture". The posture correction device is constructed so that a footboard and a calf support cuff are integrated with each other through plastic molding. The main object of the posture correction device is to prevent the imbalance of posture and wobbling.

The conventional posture correction device is constructed so that the footboard is integrated with the support cuff. Thus, when a right-handed golfer performs a swing, the left leg is rotated inwards or outwards slightly. However, since the support cuff supports the leg with the support cuff secured to the footboard, natural and good swinging posture is not assumed. Further, since the support cuff simply supports the calf, the left leg may undesirably move due to the rotation of the upper body, in the case of beginners. As a result, the conventional posture correction device is problematic in that it cannot satisfactorily achieve the main object of the device, that is, it cannot prevent imbalanced posture and wobbling.

SUMMARY OF THE INVENTION

Accordingly, the present invention has been made keeping in mind the above problems occurring in the prior art, and an object of the present invention is to provide a device for correcting golf swing posture, which is constructed so that a support cuff rotates relative to a footboard to correspond to the range of swing motion, thus correcting swing posture, and applying and supporting swing power.

In order to accomplish the above object, the present invention provides a device for correcting golf swing posture, including a footboard which is formed so that a foot is seated and supported thereon and has a pair of facing locking brackets and a foot support part for supporting a foot, a support cuff which is provided at an end of the footboard to support a leg, a lower surface of the support cuff, which contacts the footboard, being formed to be convex such that the support cuff rotates within a range of swing motion, the support cuff having locking recesses which are coupled to the locking brackets and a leg support part for supporting the leg, and a fastening means for detachably fastening the locking brackets of the footboard to the locking recesses of the support cuff, whereby the support cuff rotates about the fastening means at a predetermined angle as swing motion is conducted.

Further, the footboard further includes an extension part, the locking brackets being provided at predetermined positions on the extension part.

Each of the locking brackets of the footboard is formed to protrude upwards, and each of the locking recesses of the support cuff is cut inwards to correspond to the locking bracket, so that an outer surface of the support cuff and an outer surface of each of the locking brackets form a single surface.

The fastening means includes a threaded hole formed in each of the locking brackets, and a screw tightened into the threaded hole.

The foot support part includes a foot support hole formed at a predetermined position in the footboard, and a fastening band fastened to the foot support hole, a length of the fastening band being adjusted to correspond to a width of the foot, using a Velcro fastener.

Preferably, the leg support part includes a leg support hole formed at a predetermined position in the support cuff, and a fastening band fastened to the leg support hole, a length of the fastening band being adjusted according to a width of the leg, using a Velcro fastener.

Further, an inner surface of the support cuff is formed to correspond to a shape of an outside portion of the leg such that the outside portion of the leg is in close contact with the support cuff, and a reinforcing rib is provided on an outer surface of the support cuff.

Therefore, the support cuff can rotate relative to the footboard at a predetermined angle within the range of swing motion, so that the posture correction device can precisely correct swing posture, and can perfectly apply and support swing power, thus improving swing power, and making the ball fly in the desired direction, therefore improving golfing performance.

BRIEF DESCRIPTION OF THE DRAWINGS

The above and other objects, features and advantages of the present invention will be more clearly understood from the following detailed description taken in conjunction with the accompanying drawings, in which:

FIGS. 2*a* and 2*b* are schematic views showing the maximum rotating angle of a support cuff of the posture correction device, according to the present invention, when the support cuff rotates within the range of swing motion, in which FIG. 2*a* shows the state when a golfer performs a backswing, and FIG. 2*b* shows the state when a golfer performs a follow-through.

DETAILED DESCRIPTION OF THE INVENTION

Figure 1:
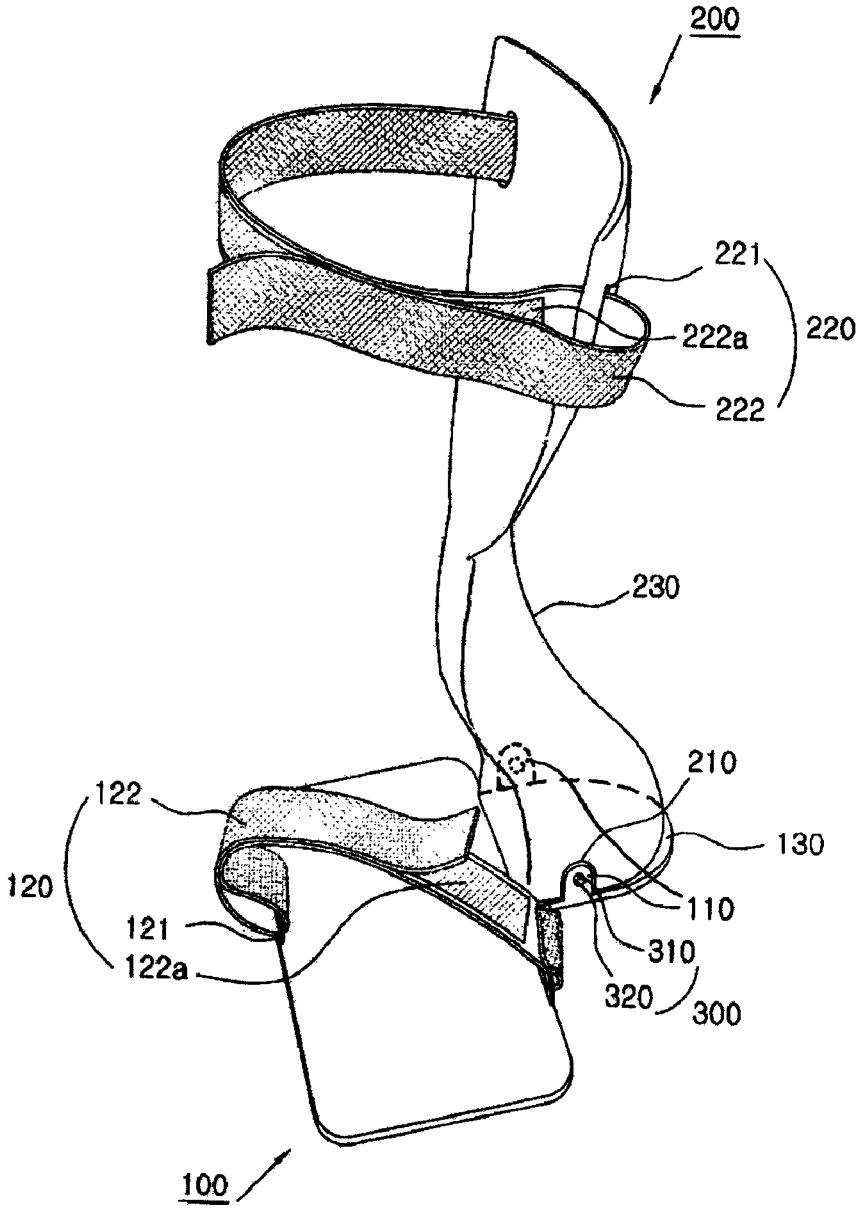
FIG. 1 is a perspective view showing a device for correcting golf swing posture, according to the present invention.
Figure 2:
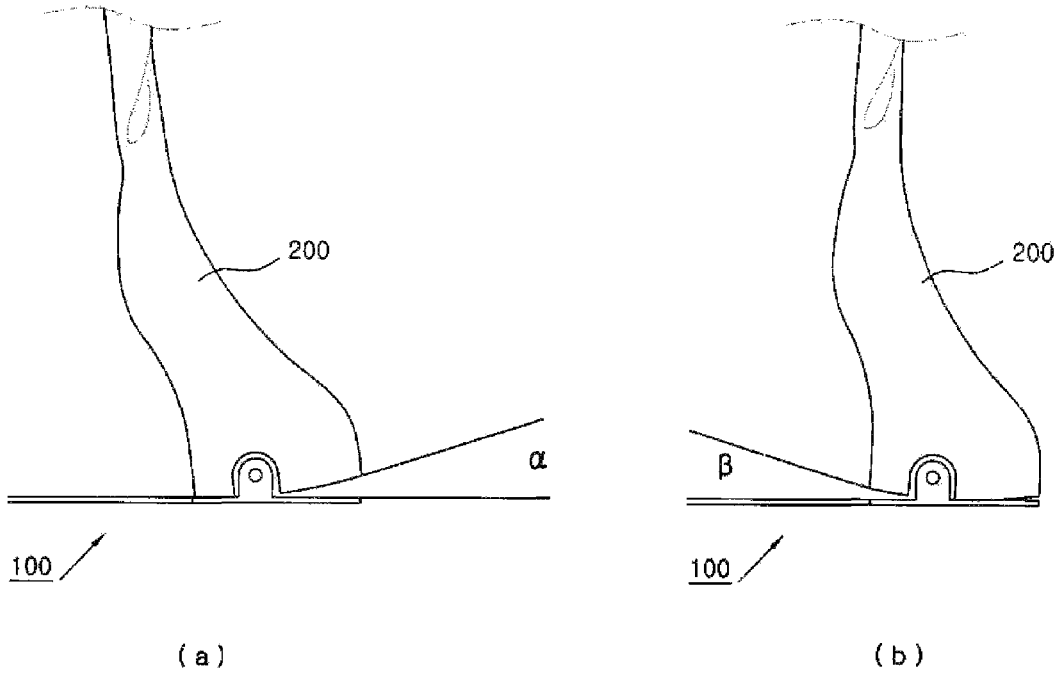

Hereinafter, the preferred embodiment of the present invention will be described in detail with reference to the accompanying drawings. FIG. 1 is a perspective view showing a device for correcting golf swing posture, according to the present invention, FIGS. 2*a* and 2*b* are schematic views showing the maximum rotating angle of a support cuff of the posture correction device, according to the present invention, when the support cuff rotates within the range of swing motion, and FIGS. 3*a* to 3*d* are views illustrating the operation of the device for correcting golf swing posture, according to the present invention.

As shown in the drawings, the device for correcting golf swing posture according to the present invention has a structure which is suitable for a right-handed golfer. The posture correction device includes a footboard 100, a support cuff 200, and a coupling unit. The footboard 100 has the shape of a flat plate so that the foot is seated on the footboard 100 and the footboard 100 is in close contact with the ground. The support cuff 200 is mounted to one edge of the footboard 100, and supports a golfer's calf so as to prevent the leg from moving when he or she performs a swing. In particular, the support cuff 200 coupled to the footboard 100 rotates to correspond to the movement of the leg during the swing motion.

The footboard 100 has the shape of a flat plate, thus allowing the foot to be stably seated on the footboard 100. Preferably, the footboard 100 is made of a material which is not thick but is strong, so that the right foot is on the same level as the left foot when a golfer performs a swing. If necessary, a wedge may be integrally provided on the bottom of the footboard 100 so as to fix the footboard 100 to the ground.

Preferably, a pair of locking brackets 110 is provided in the side of the footboard 100 in such a way as to protrude upwards, so that the support cuff 200, which will be described below, is coupled at both sides thereof to the footboard 100. The locking brackets 110 are coupled to locking recesses 210, which are formed in the support cuff 200, so that the footboard 100 is stably coupled to the support cuff 200.

Preferably, an extension part 130 is further provided at one end of the footboard 100. That is, the portion of the footboard 100 that is coupled to the support cuff 200 extends to a predetermined position, thus forming the extension part 130. The extension part 130 prevents force from being concentrated at the junctions of the support cuff 200 and the footboard 100, that is, the locking brackets 110 and the locking recesses 210, when force concentrated on the left side by swing motion is applied to the support cuff 200. The extension part 130 distributes the force to the support cuff 200 and the footboard 100.

Further, a foot support part 120 is provided on the footboard 100 so that the foot is seated and supported on the footboard 100. The foot support part 120 prevents the foot from unnecessarily rotating and moving during the swing motion, thus allowing a golfer to acquire correct swing posture.

The foot support part 120 includes foot support holes 121 and a fastening band 122. The foot support holes 121 are formed in both ends of the footboard 100. The fastening band 122 is fastened to the foot support holes 121. The length of the fastening band 122 is adjusted to match the width of the golfer's foot using a Velcro fastener 122*a*.

One side of the fastening band 122 is fixed to the foot support hole 121, which is formed in one end of the footboard 100, while the other side of the fastening band 122 is inserted into the foot support hole 121, which is formed in the other end of the footboard 100. After the golfer's foot is fitted into the fastening band 122, the length of the fastening band 122 is adjusted to match the width of the foot, and the fastening band 122 is fastened using the Velcro fastener 122*a*. In this way, the foot is secured to the footboard 100.

Further, the support cuff 200 is coupled to the footboard 100 using the locking brackets 110 which are provided at one side of the footboard 100. The support cuff 200 has the locking recesses 210 at positions corresponding to the locking brackets 110, so that the locking brackets 110 of the footboard 100 are coupled to the locking recesses 210.

Each locking recess 210 is cut inwards to correspond to the shape of each locking bracket 110. When the locking brackets 110 are coupled to the locking recesses 210, the outer surface of the support cuff 200 and the outer surface of each locking bracket 110 form a single surface. Such a construction allows the locking brackets 110 to be stably coupled to the locking recesses 210, in addition to providing a good external appearance.

Here, when the support cuff 200 rotates about a fastening means 300, which will be described below, at a predetermined angle, each locking bracket 110 must be sufficiently rotated in the corresponding locking recess 210 according to the rotation radius of the locking bracket 110. To this end, it is preferable that each locking recess 210 be slightly larger than the locking bracket 110.

Further, the lower surface of the support cuff 200, contacting the footboard 100, is preferably formed to be convex so that the support cuff 200 rotates within the range of swing motion. As shown in FIGS. 2*a* and 2*b*, the range of swing motion means the range from the angle $\alpha$ of the left leg with the central line when a golfer performs a backswing as shown in FIG. 2*a* and the center of his or her weight is to the right side, to the angle $\beta$ of the left leg, which leans outwards when the golfer performs a follow-through, as shown in FIG. 2*b* and the center of his or her weight is to the left side. The range of swing motion is usually from 5 degrees to 7 degrees relative to the center of the support cuff 200, even though it may vary according to the golfer.

Further, a leg support part 220 is provided on the support cuff 200, so that the leg is in close contact with and is secured to the inner surface of the support cuff 200. The leg support part 220 prevents the leg from unnecessarily rotating and moving when a golfer performs a swing, thus allowing him or her to acquire correct swing posture.

The leg support part 220 includes leg support holes 221 and a fastening band 222. The leg support holes 221 are formed in both ends of the support cuff 220 in such a way as to be positioned around the calf region. The fastening band 222 is fastened to the leg support holes 221, and the length of the fastening band 222 is adjusted according to the width of the leg using a Velcro fastener 222*a*. One side of the fastening band 222 is fastened to the leg support hole 221 which is formed in one end of the support cuff 200, while the other side of the fastening band 222 is inserted into the leg support hole 221 which is formed in the other end of the support cuff 200. After the leg is fitted into the fastening band 222, the length of the fastening band 222 is adjusted according to the width of the golfer's leg. Thereafter, the fastening band 222 is fastened using the Velcro fastener 222*a*, so that the leg is secured to the support cuff 200.

Here, the inner surface of the support cuff 200 is formed to correspond to the shape of the leg, that is, the outside portion of the left leg, thus allowing the leg to be in close contact with the support cuff 200, allowing the posture correction device to be stably worn, and preventing the leg from unnecessarily rotating and moving, therefore allowing the golfer to acquire correct swing posture.

Preferably, a reinforcing rib 230 having the shape which is similar to that of the leg muscle of the body is further provided on the outer surface of the support cuff 200. The reinforcing rib 230 makes the muscle portion, on which power is concentrated during swing motion, thicker, thus preventing the support cuff 200 from being destroyed by strong swing power.

Further, the locking brackets 110 of the footboard 100 and the locking recesses 210 of the support cuff 200 are detachably fastened to each other using the fastening means 300. Thus, when a golfer desires to store or carry the posture correction device, the footboard 100 and the support cuff 200 may be separated from each other. Here, the fastening means 300 fastens each locking bracket 110 to the corresponding locking recess 210, in addition to serving as a rotating shaft when the support cuff 200 rotates within the range of swing motion.

The fastening means 300 may be a hinge fastening structure or a screw fastening structure, as long as the fastening means fastens each locking bracket 110 to the locking recess 210 and serves as the rotating shaft. However, it is preferable that the fastening means 300 include threaded holes 310 formed in the locking brackets 110 and the locking recesses 210 and screws 320 tightened into the corresponding threaded holes 310, so that a golfer can easily and quickly separate the support cuff 200 from the footboard 100.

The operation and effect of the present invention will be described below. For the convenience of description, the function of the posture correction device according to the present invention is not shown in FIGS. 3*a* to 3*d*, in which a golfer performs a swing from a backswing to a follow-through.

Figure 3:
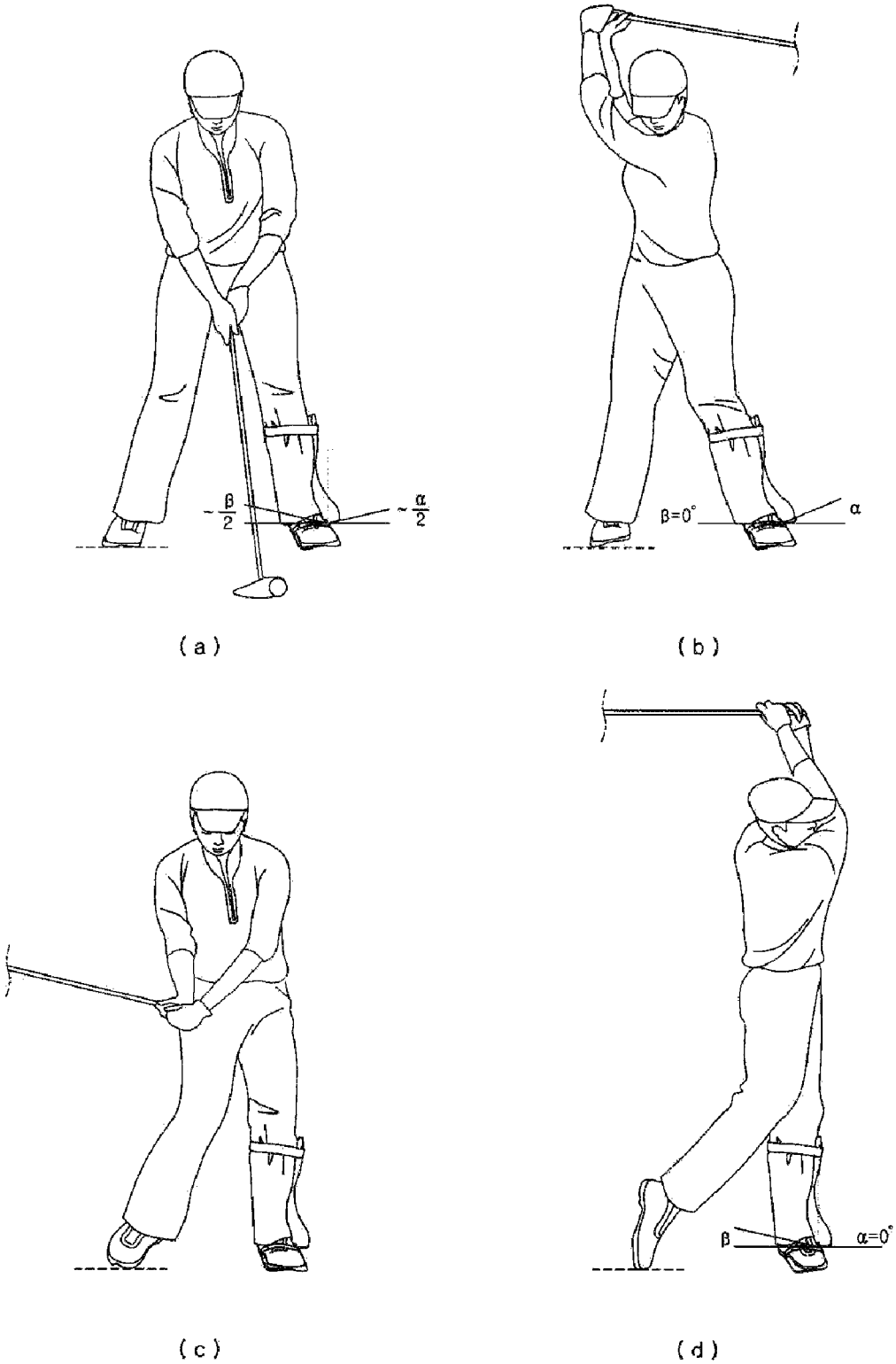
FIGS. 3*a* to 3*d* are views illustrating the operation of the device for correcting golf swing posture, according to the present invention.

FIG. 3*a* shows the state where the golfer assumes an address posture (preparation posture). At this time, the center of weight is at the center of the body, and the weight evenly acts on the right foot and the left foot. In this case, the support cuff 200 is not rotated leftwards or rightwards, but is maintained at the center. The angle of the support cuff 200, which is inclined during a swing motion, is denoted by $\alpha$ on the outside of the leg, and is denoted by on the inside of the leg. At address, each of $\alpha$ and $\beta$ is about half of the maximum angle.

FIG. 3*b* shows the state where the golfer's posture changes from the address posture to the backswing posture. Momentarily, the center of weight is in the right part of the body, and the shoulders are turned slightly backwards to the right, so that power is loaded in the shoulders. Simultaneously, the left leg leans slightly to the center of the body, and the right side of the waist is turned backwards. In this case, the support cuff 200 serves to prevent the waist from turning excessively backwards, and is rotated within the range in which the left leg is inclined inwards during the swing motion. In this case, $\alpha$ forms the maximum angle by which the support cuff 200 may be inclined towards the center, and the angle $\beta$ of the support cuff 200 at the inside of the leg is zero. Thereby, when the golfer performs the following motion, that is, performs a downswing or a follow-through, power is appropriately generated from the waist and the shoulders, so that a desired swing power and a stroke in the intended direction are achieved.

FIG. 3*c* shows the state where the golfer's posture changes from a backswing to a downswing. The center of weight is slowly shifted to the left. Thereby, the support cuff 200 is gradually inclined outwards.

FIG. 3*d* shows the state in which the golfer performs a follow-through. At this time, the center of weight is positioned far to the left. The shoulders are turned backwards to the left, so that force is removed from the shoulders, and simultaneously, the left leg is inclined slightly outwards. In this case, the support cuff 200 prevents the left leg from being excessively inclined towards the outside of the body due to the swing power of the shoulders when the golfer's swing is performed continuously from the downswing. The support cuff 200 rotates within the range in which the left leg is inclined outwards during the swing motion. In this case, the support cuff 200 is inclined outwards maximally, so that $\alpha$ is zero, and the support cuff 200 inclined to the outermost side has the angle of $\beta$. This prevents a golfer's body from wobbling due to swing power after he or she performs a follow-through, thus allowing him or her to stably complete the swing, therefore preventing the dissipation of swing power, and allowing the golfer to stably and correctly perform a swing.

As a golfer continues to practice swinging using the posture correction device of this invention, the legs, waist, and shoulder muscles remember the constraints imposed by the posture correction device. Thereby, the golfer can stably perform a swing while maintaining good posture even without wearing the posture correction device, so that the posture correction device of the present invention improves golfing performance and increases the efficiency of exercise.

As described above, the present invention provides a device for correcting golf swing posture, in which a support cuff can rotate relative to a footboard at a predetermined angle within the range of swing motion, so that the posture correction device can precisely correct swing posture, and can perfectly apply and support swing power, thus improving swing power, and making the ball fly in the desired direction, therefore improving golfing performance.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A device for correcting a golf swing posture, comprising:

a footboard having a shape to place and support a foot thereon, and having a pair of opposing locking brackets and a foot support part for securely supporting a foot on the footboard;

a support cuff provided at a lateral side of the floorboard to support a side of a leg with the support cuff, the support cuff coupled to the locking brackets, the support cuff pivotally moveable, within a predetermined pivot angle, about the opposing locking brackets in a side-to-side manner with respect to the foot secured on the footboard, the support cuff having a leg support part for securely supporting the leg with the leg support part; and fastening means for fastening the locking brackets of the footboard to the support cuff, whereby the support cuff can pivot about the locking brackets within the predetermined pivot angle as a golfer wearing the device practices a golf swing.

2. The device as set forth in claim 1, wherein a lower end surface of the support cuff has a generally convex shape such that the pivotal movement of the support cuff can be limited by contact of the convex edge of the support cuff abutting against an upper surface of the footboard.

3. The device as set forth in claim 2, wherein the support cuff includes a pair of opposing locking recesses for coupling with the locking brackets, and each of the locking brackets of the footboard protrudes upwards, and each of the locking recesses of the support cuff is cut inwards to correspond to the locking bracket, so that an outer surface of the support cuff and an outer surface of each of the locking brackets form a single surface.

4. The device as set forth in claim 3, wherein the fastening means is detachable from the locking brackets, and the fastening means comprises:

a screw tightened into a threaded hole formed in each of the locking brackets.

5. The device as set forth in claim 1, wherein the foot support part comprises:

a fastening band fastened to a foot support hole formed at a predetermined position in the footboard, a length of the fastening band being adjustable to correspond to a size of the foot, using a Velcro fastener.

6. The device as set forth in claim 1, wherein the leg support part comprises:

a fastening band fastened to a leg support hole formed at a predetermined position in the support cuff, a length of the fastening band being adjustable according to a size of the leg, using a Velcro fastener.

7. The device as set forth in claim 1, wherein an inner surface of the support cuff is formed to correspond to a shape of an outside portion of the leg such that the outside portion of the leg is in close contact with the support cuff, and a reinforcing structure is provided on an outer surface of the support cuff.

8. The device as set forth in claim 1, wherein the footboard further comprises an extension part extending to a side of the footboard, the locking brackets being provided at predetermined positions on the extension part.

9. A device for correcting a golf swing posture, comprising:

a footboard for placing a foot thereon, and having a pair of opposing brackets coupled to the footboard and a foot support part for securing a foot on the footboard;

a support cuff provided at a lateral side of the footboard to support a side of a leg with the support cuff, the support cuff pivotally coupled to the brackets, the support cuff pivotable within a predetermined pivot angle and about the opposing brackets in a side-to-side direction with respect to the foot secured on the footboard, the support cuff having a leg support part for securing the leg with the leg support part; and fastening means for fastening the brackets of the footboard to the support cuff, whereby the support cuff can pivot about the brackets within the predetermined pivot angle as a golfer wearing the device practices a golf swing.

10. The device as set forth in claim 9, wherein the footboard further comprises an extension part extending to a side of the footboard, the brackets being provided at predetermined positions on the extension part.

11. The device as set forth in claim 9, wherein the predetermined pivot angle of the support cuff is from 5 degrees to 7 degrees relative to a neutral position of the support cuff.

* * * * *